United States Patent [19]

Immel

[11] 4,344,422

[45] Aug. 17, 1982

[54] ORTHOPEDIC BED

[76] Inventor: Joseph D. Immel, 4809 Green Acres Rd., St. Joseph, Mo. 64506

[21] Appl. No.: 156,696

[22] Filed: Jun. 5, 1980

[51] Int. Cl.[3] ..... A61H 1/00; A47C 20/08

[52] U.S. Cl. ..... 128/33; 5/69; 5/109

[58] Field of Search ..... 5/69, 109, 67, 66, 61, 5/68, 186 B; 297/260; 128/33, 32–36

[56] References Cited

U.S. PATENT DOCUMENTS

| | | | |
|---|---|---|---|
| 1,908,530 | 5/1932 | Nixon | 5/69 |
| 2,004,549 | 6/1935 | Boyd | 5/186 B |
| 2,539,712 | 1/1951 | Wettlaufer | 128/33 |
| 2,632,898 | 3/1953 | Pardoe | 5/69 |
| 3,636,573 | 1/1972 | Bartz | 5/66 |
| 3,724,004 | 4/1973 | Behrens | 5/66 |

*Primary Examiner*—Thomas J. Holko
*Assistant Examiner*—Michael Trettel

[57] ABSTRACT

The bed is divided into three articulated elements which are interconnected by linkages to allow pivotable movement between the elements for positioning a patient in any one of a plurality of positions. A hydraulic cylinder is operated through a hand actuated valve for raising and lowering the bed portions. A main pivot tube is attached to the base of the bed and provides a hinge joint for two of the bed portions. An eccentric rod extends through the pivot tube and is operative to cause oscillation of the bed.

9 Claims, 5 Drawing Figures

12
82
24
28
18
64
58
62
22
26
30
76
19
20
54
50
39
44
40
43
42
4
4
14
16
56
36
60
32
52
46
48
10
80

ORTHOPEDIC BED

BACKGROUND OF THE INVENTION

1. Field of the Invention

This invention relates to bed structures which can be moved to various folded positions about an eccentric pivot member to accommodate the needs of individual patients.

2. Discussion of Related Art

Beds have been suggested which include tilting or bending portions to provide a more comfortable position for a person to lie in. For instance, U.S. Pat. No. 3,636,573, issued Jan. 25, 1972 to Bartz, shows a foldable mattress support with head and foot sections which are pivotably connected and manipulated between a flat position and positions at selected angular dispositions. Flexible straps interconnect marginal portions of a frame. U.S. Pat. No. 3,184,765, issued May 25, 1965 to Katz, shows a bed having a head section, another section pivoted at its rear end to the forward end of the head section and means to support the bed on a base permitting the head section to move from a position coplanar with the other section to an angular position of less than 180° relative thereto. U.S. Pat. No. 2,500,742, issued Mar. 14, 1950 to Taylor, shows an invalid's bed comprising a frame having a transverse member and longitudinal rails and a raisable mattress supporting frame section having side flanges comprising downwardly opening channels receiving the rails and having end portions slidable thereon adjacent the transverse member but spaced therefrom by gaps. The width of the gaps varies with sliding movement of the end portions.

SUMMARY OF THE INVENTION

One object of the present invention is to provide an orthopedic bed having a patient supporting platform which can easily be tilted to any number of inclined positions.

A further object of the present invention is to provide an orthopedic bed having a patient supporting platform which can be caused to oscillate in a vibratory manner to facilitate the treatment of back and circulatory ailments.

Yet still another object of the present invention is to provide an orthopedic bed wherein the tilting and oscillating components are related so as to reduce the weight of the overall bed.

One additional object of the present invention is to provide an orthopedic bed having a plurality of hinged sections wherein the sections are capable of consistent, articulated motion using minimum linkage between the sections.

In accordance with the above objects, the orthopedic bed of the present invention comprises three hinged sections. These sections include a head support section, foot support section and intermediate section. The hinged joint between the head and the intermediate sections is mounted upon a pivot tube which is attached to a resilient platform. The pivot tube includes an eccentric shaft disposed therein for causing oscillation of the entire bed. The head support section and the hinged joint between the intermediate and leg support sections are interconnected by a pair of bell cranks and connector rods such that when the head support section is raised, the hinged joint between the intermediate and foot support sections is also raised thereby disposing the intermediate and foot support sections in downwardly diverging relation. A hydraulic cylinder has its piston attached to the head support section in order to raise that section. A manually operated valve is disposed in a convenient position so that the patient can easily actuate the valve when raising of the bed is desired.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
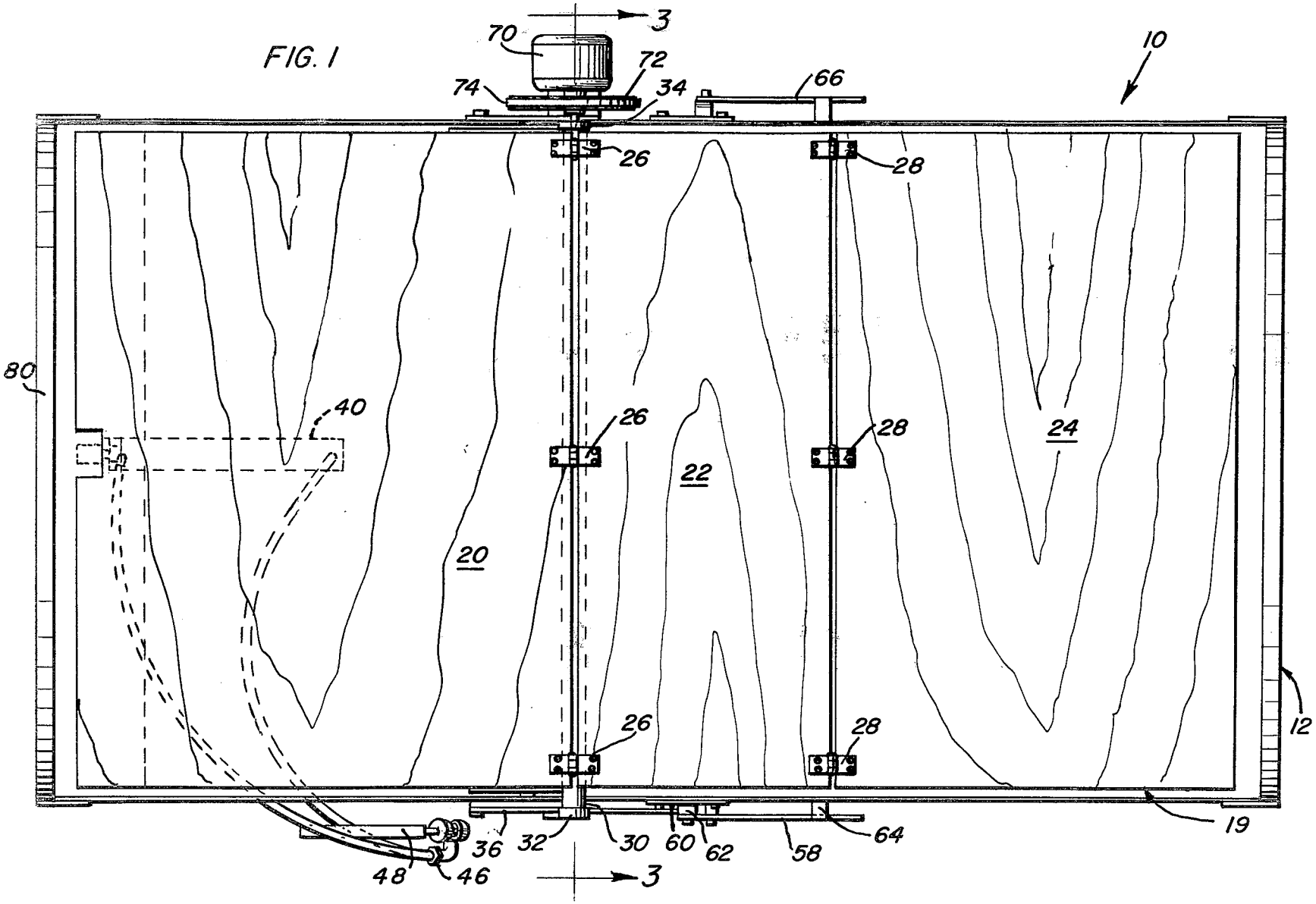
FIG. 1 is a top plan view of the orthopedic bed.

Now with reference to the drawings, an orthopedic bed incorporating the principles and concepts of the present invention and generally referred to by the reference numeral 10 will be described in detail. Bed 10 includes a frame 12 which can be any standard bed frame having longitudinal frame members 14 which support a resilient support platform 15 in the form of spring assembly 16. A hard planar surface such as wooden board 18 rests on top of and is attached to the spring assembly 16. A three-part articulated mattress support platform 19 is mounted on top of board 18 and comprises head support section 20, intermediate section 22 and foot support section 24. Each of the sections 20, 22 and 24 is a substantially planar panel which can be composed of plywood or any other sturdy material. The head support section 20 and intermediate section 22 are hingedly connected by use of hinges 26 while the intermediate and foot support sections are connected by use of hinges 28 such that each of the sections can pivot with respect to the adjacent section. The mattress support platform 19 is attached to board 18 by the use of pivot tube 30 which is mounted and journaled in bearings 32 and 34 which are held fixed with respect to frame 12. The bearings 32 and 34 are connected to frame side members 14 through connector plates 36 and 38.

The head support section 20 is raised through the extension of piston shaft 39 of a double acting hydraulic cylinder 40 which has a lower end 43 mounted at hinge 42 to the board 18. The piston shaft 39 of cylinder 40 is pivotally attached to the upper portion of head support section 20 at hinge 44. An operating valve 46 is attached to the frame 12 and is provided with operating handle 48 positioned conveniently along side the head support section 20 in order that a patient can easily reach it. Valve 46 is connected to the double acting hydraulic cylinder 40 and a standard hydraulic supply to cause operation of cylinder 40.

Figures 2, 5:
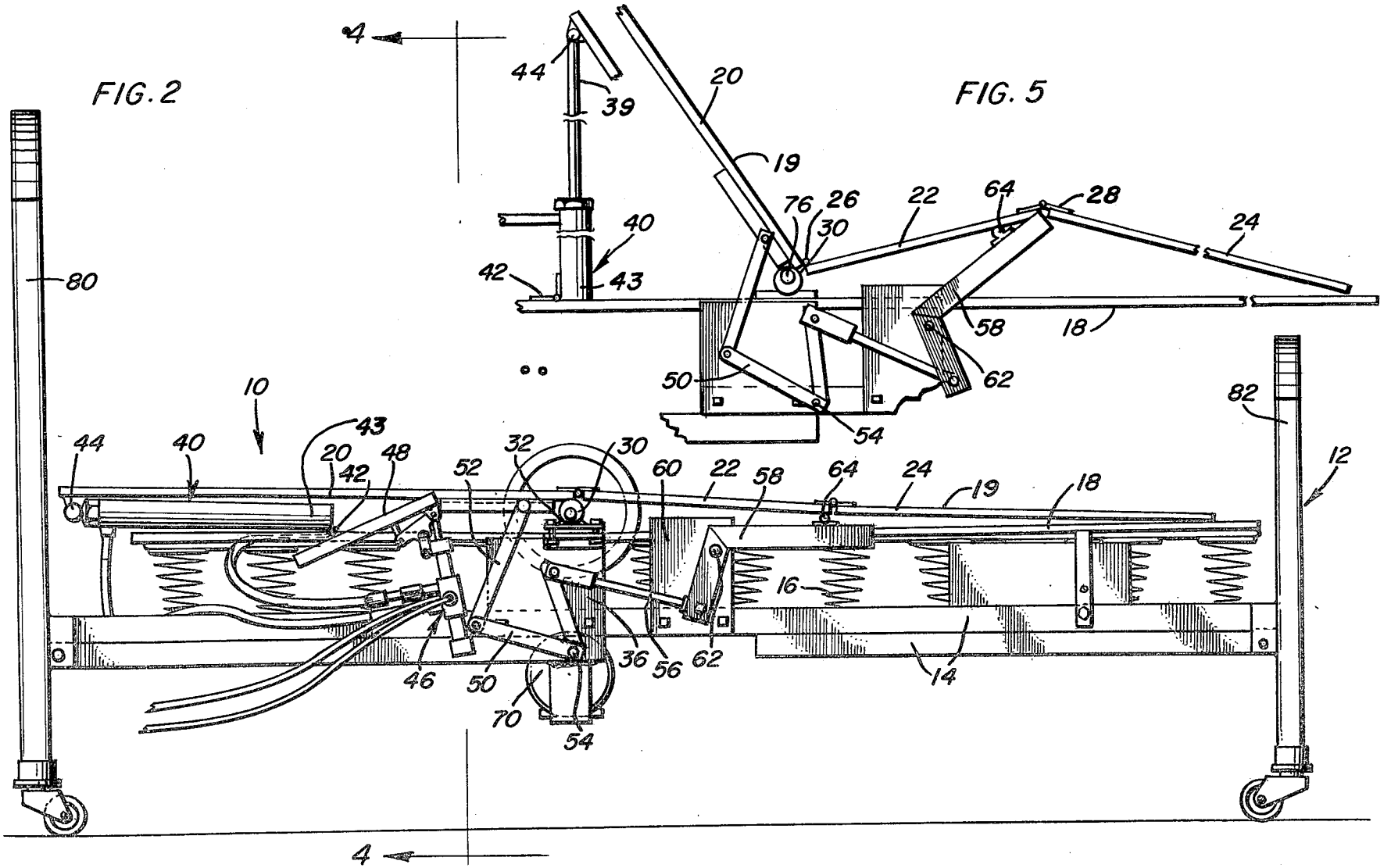
FIG. 2 is a side elevational view of the bed.
FIG. 5 is a part schematic view showing the bed in the raised position.
Figure 3:
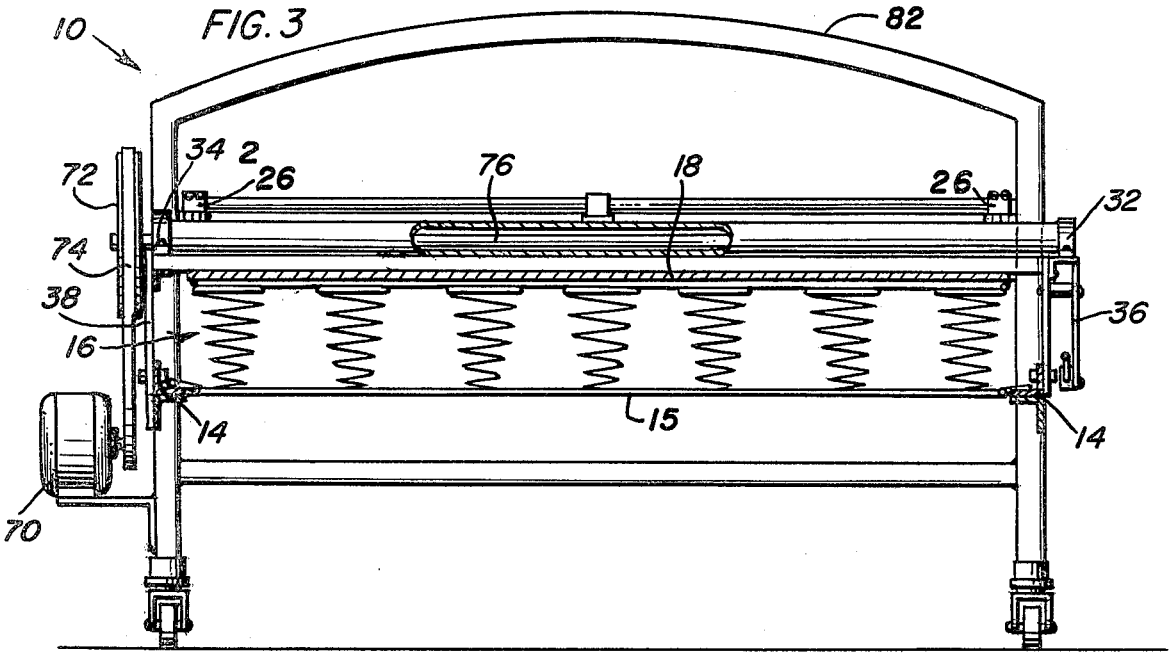
FIG. 3 is an elevational sectional view taken substantially along a plane passing through section line 3—3 of FIG. 1.
Figure 4:
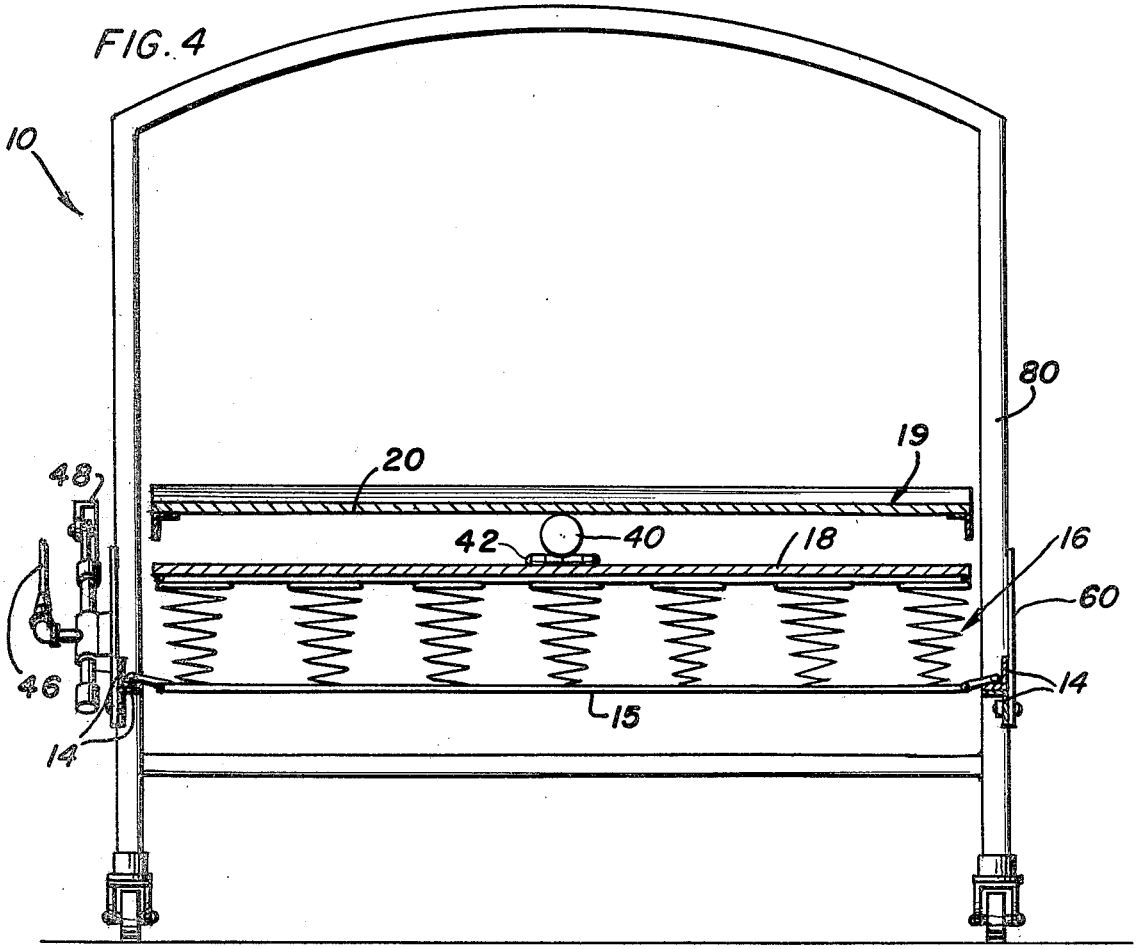
FIG. 4 is an elevational sectional view taken substantially along a plane passing through section line 4—4 of FIG. 2.

The head support section 20 is attached to bell crank 50 through connector arm 52. Connector arm 52 is pivotally attached at one end to the lower portion of head support section 20 and pivotally attached at the other end to the bell crank 50. Accordingly, movement of head support section 20 causes bell crank 50 to pivot about connector pin 54 which mounts the bell crank on plate 36. The substantially vertical motion of connector arm 52 is translated through bell crank 50 to substantially horizontal motion of a second connector arm 56 which is attached to one portion of a second bell crank 58. Bell crank 58 is mounted on an attachment plate 60 and the bell crank 58 pivots about shaft 62 which extends across the width of the bed and connects to a similar bell crank 66 disposed on the opposite side thereof. A support shaft 64 extends between the ends of bell cranks 58 and 66 and supports the end of intermediate section 22 which is hinged to foot support 24. Accordingly, when the head support is raised, connecting arm 52 is also raised causing the bell crank 50 to pivot about pivot pin 54. This pushes the connecting rod 56 longitudinally along the bed causing bell cranks 58 and 66 to pivot with shaft 62. This forces support shaft 64 upwardly and in turn the hinge 28 between portions 22 and 24 is moved upwardly as shown in FIG. 5 to dispose the bed in an inclined, articulated position.

The bed can also be vibrated on operation of motor 70 which drives pulley 72 through belt 74. Pulley 72 is mounted on eccentric shaft 76 which is positioned within pivot tube 30. Accordingly, when shaft 76 is rotated, the pivot tube vibrates and transmits such vibration to the entire mattress support platform 19.

The components of the invention are designed so as to be able to be fitted on an existing bed structure including frame 12 which has headboard 80 and footboard 82 interconnected by the longitudinal frame members 14 in a conventional manner. The spring assembly 16 can be in the form of any standard available spring structure including box springs. In order to change the bed into an orthopedic bed, all that need be done is to secure appropriate connector and attachment plates 36 and 60 to the longitudinal frame members 14 by the use of bolts or any other standard available securing mechanism. The board 18 is placed on top of the spring assembly 16 and the remaining elements of the invention are attached to either the mounting connector and attachment plates 36, 60 or the board 18 as can be seen. Thus, use is made of standard available components to provide a portion of the orthopedic bed. The use of spring assembly 16, it will be noted, also provides damping for the oscillatory motion of the mattress support platform 19 to keep some of the vibrations from being passed through the frame 12 into the support platform 15 upon which the bed rests. This is an important feature when used in a home environment as the occupant of the bed should be able to utilize the bed to its fullest without annoying other occupants of the house.

Also, it will be seen that the mattress support platform 20, 22, 24 and support plates 36, 60 can be removed from the bed frame members 14 and springs 16 and stored when not needed. Thus, the bed frame members and springs can be used as a conventional bed.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An orthopedic bed comprising a frame, a mattress support structure mounted on said frame, said mattress support structure including three hinged sections, said hinged sections comprising a head support section, intermediate section and foot support section; a pivot tube connected to said frame, said pivot tube also being attached to said head support and intermediate sections for limiting movement thereof to pivotable movement about said tube; linkage means connected to said head support section and said intermediate section for causing pivotal movement of said intermediate section upon pivotal movement of said head support section; said linkage means including a first bell crank, a first control arm extending from said head support section to one side of said first bell crank, a second bell crank, a second control arm extending from said first bell crank to said second bell crank, a support rod extending from said second bell crank, said intermediate section resting upon said support rod, an eccentric shaft disposed in said pivot tube and having a motor attached to said eccentric shaft for causing rotation thereof thereby vibrating said mattress support structure, and power lift means attached to said head support section for lifting said head support section.

2. The invention as defined in claim 1 wherein said power lift means includes a hydraulic cylinder.

3. The invention as defined in claim 2 and further including a valving member mounted upon said frame, said valving member having an acuation handle disposed in proximate relation to said head support section.

4. The invention as defined in claim 1 wherein said mattress support structure is mounted upon a planar surface means, said planar surface means being mounted upon a bed spring structure, said bed spring structure resting upon said frame.

5. An orthopedic bed comprising a head support section responsive to drive means raising and lowering the head support section and which is connected by first hinge means to an intermediate section, said intermediate section being connected by a second hinge means to a foot support section, linkage means intercoupling the head support section and the intermediate section, a hollow pivot tube mounted to the first hinge means of said head support section and said intermediate section cooperating with said linkage means and said drive means for permitting pivotal motion of said head support section and of said intermediate section only in an upwardly diverging relation responsive to the linkage means bearing on a support shaft; and an eccentric shaft disposed in said hollow pivot tube for causing vibratory motion of said pivot tube.

6. The invention as defined in claim 5 and further including said linkage means disposed between said head support section and said intermediate section, said linkage means including a first control arm attached to said head support section and disposed in a depending relation therefrom, a first bell crank attached to said first control arm, a second control arm connected to said second bell crank and disposed for generally horizontal movement upon vertical displacement of said first control arm, a second bell crank attached to said second control arm and said support shaft disposed in laterally extending position from said second bell crank for lifting said intermediate section upon said head support section being lifted.

7. The invention as defined in claim 5 wherein said head support section, intermediate section and foot support sections are mounted upon a bed spring construction.

8. The invention as defined in claim 5 and further including a hydraulic cylinder attached to said head support section for causing powered movement thereof.

9. The invention as defined in claim 8 and further including a control valve connected to said hydraulic cylinder, said control valve being disposed in proximate relation said head support section for allowing convenient control of said hydraulic cylinder.

* * * * *